US005474805A

United States Patent [19]

Vaughn

[11] Patent Number: 5,474,805

[45] Date of Patent: Dec. 12, 1995

[54] METHOD FOR PREPARING AND PRODUCING PRINTED PALETTES OF WATER COLOR INKS OR PAINTS CONTAINING MICROENCAPSULATED SCENTS

[76] Inventor: Larry F. Vaughn, 1158 Mansville Ave., Indiana, Pa. 15701

[21] Appl. No.: 195,484

[22] Filed: Feb. 14, 1994

Related U.S. Application Data

[63] Continuation-in-part of Ser. No. 823,307, Jan. 21, 1993, abandoned.

[51] Int. Cl.[6] ..... B05D 5/00; B05D 5/10

[52] U.S. Cl. ..... 427/207.1; 427/208.6; 427/288; 427/282; 434/84

[58] Field of Search ..... 427/207.1, 208.6, 427/288, 282; 434/84

[56] References Cited

U.S. PATENT DOCUMENTS

| | | | |
|---|---|---|---|
| 3,544,364 | 12/1970 | Rudner et al. | 117/143 |
| 3,570,139 | 3/1971 | Ladd et al. | 35/8 |
| 3,578,482 | 5/1971 | Whitaker et al. | 117/38 |
| 4,752,496 | 6/1988 | Fellows et al. | 427/27 |
| 4,940,584 | 7/1990 | Tararuj et al. | 424/401 |
| 4,952,400 | 8/1990 | Tararuj et al. | 424/401 |
| 4,988,557 | 1/1991 | Charbonneau | 428/204 |
| 5,018,974 | 5/1991 | Carnahan et al. | 434/98 |
| 5,039,243 | 8/1991 | O'Brien | 401/49 |

*Primary Examiner*—Shrive Beck
*Assistant Examiner*—Katherine A. Bareford
*Attorney, Agent, or Firm*—Luedeka, Neely & Graham

[57] ABSTRACT

A method for producing printed layers of water color inks is disclosed for providing palettes of color which may be wetted and transferred. A specially prepared ink is printed in a typical printing process to produce a palette on a substrate for subsequent re-wetting and transfer by a user. The ink is preferably printed using silk screen or flexographic processes to produce a layer of ink on the palette which is sufficiently thick to allow it to be re-wetted and transferred. The method is particularly useful for preparing limited use palettes for use in painting kits. Such palettes provide water color paints having microencapsulated fragrances for painting "scent pictures". The use of traditional printing processes to provide a transferable palette of colors on substrates such as paper allows the cost of preparing such palettes to be substantially reduced, such that single use, disposable palettes are economically feasible.

7 Claims, 2 Drawing Sheets

METHOD FOR PREPARING AND PRODUCING PRINTED PALETTES OF WATER COLOR INKS OR PAINTS CONTAINING MICROENCAPSULATED SCENTS

RELATED APPLICATION

This application is a continuation-in-part of application Ser. No. 07/823,307 filed Jan. 21, 1992, now abandoned.

FIELD OF THE INVENTION

This invention relates to the field of inks and paints for color palettes and particularly to a method for preparing color palettes of inks or paints containing microencapsulated fragrances therein which may be printed to form layers and subsequently re-wetted and transferred.

BACKGROUND OF THE INVENTION

While the printing of various inks and paints is a well known process, the printing of color palettes with scents by traditional techniques to form an inexpensive, easily manufactured intermediate product for painting subsequent designs is not currently known in the art. Current palette production methods are generally effective for producing multiple use palettes. However, these palettes usually have a relatively high cost due to the amount of ink or paint provided and are not subject to inexpensive production. For example, traditional methods for producing palettes require special substrates which form cups to hold the liquid ink or paint once it is initially deposited and the amount of ink or paint in the palette increases the cost so that it is relatively expensive if used only once. Furthermore, such economic considerations limit the number of colors provided on a typical palette, since it would not be cost effective to provide colors which would receive little use. Furthermore, there is currently no product in existence which provides palettes containing inks having microencapsulated fragrances.

The common "scratch and sniff" technique has been utilized to combine fragrance effects with printed material. For example, microencapsulated fragrances have been used to create "scratch and sniff" books, stickers, or advertisements. A viewer of the material would scratch the printed areas resulting in a rupture of microcapsules such that the fragrance would be released and smelled. U.S. Pat. No. 3,578,482, to Whitaker et al., discloses a slurry for forming such effects.

Such techniques have gained wide popularity in advertising due to the fact that the visual impact of the advertisement is enhanced by the addition of the fragrance. The "scratch and sniff" technique has been used to enhance children's books in a similar manner. The impact of the combination of multiple sensory effects (i.e., sight and scent or flavor) provides for an enhanced memory of the material, a great plus both in advertising and education.

Despite the use of microencapsulated fragrances or flavors in advertising and printed materials, there is no "scratch and sniff" paint palette available to consumers so that they may paint their own "scratch and sniff" artwork. The prior art in microencapsulated fragrances and printing materials relates exclusively to the printing of a material such that the next step in the use of the material is the rupture of the microcapsules and release of the chemical. None of these prior art formulations provide a paint or ink slurry containing microcapsules which may be initially printed, but then subsequently transferred as the user desires. For example, even though the slurry disclosed in Whitaker is a water based slurry, the teaching does not disclose a transferable product. As is well known in the printing art, typical printed layers of ink bond to the fibers of the paper and are in fact held on the paper by such bonds. Thus, even in water soluble inks, a mere re-wetting of the printed ink will not allow for the transfer of ink in sufficient quantities to paint another product. In fact, the prior art is primarily concerned with the ink not being transferable after printing since prior art techniques have focused on the durability of the printed matter. To accomplish this goal, a binder was used which is initially hot water soluble but is insoluble once printed and dry. Examples of such prior art binders are polyvinyl alcohol, starches and polymer emulsions.

It is therefore an object of the present invention to provide a method for efficiently and inexpensively producing color palettes.

It is a further object of the present invention to provide color palettes using traditional printing techniques to reduce costs and increase production capacity.

It is an object of the present invention to provide a water color paint palette containing microencapsulated chemicals which may be printed in layers of sufficient thickness such that the paints and microcapsules may be subsequently transferred by a consumer.

SUMMARY OF THE INVENTION

In accordance with the above described objects the present invention relates to a method for preparing color palettes from which a user could obtain paints or inks for preparing a design. In the preferred embodiment, a paint or ink is prepared for printing by mixing the desired pigments, binders, solvents and microcapsules to form the desired paint. The paint is then printed to a substrate using, preferably, the silk screen method or, alternatively, flexographic printing processes. The mesh size of the silk screen or the percentage of line screen of the flexographic plate is selected to allow a sufficient thickness of paint (or ink) to be deposited on the substrate so that after the printed paint has dried, it may be re-wetted and transferred by a user.

Preferably, the thickness of the ink or paint layer on the substrate should be between about 1–2 mils to insure that sufficient paint is present in the printed area that it may be removed upon re-wetting in sufficient quantities to effectively color a subsequent design. Typically, a multi-step printing process would be utilized, such as silk screen or flexographic, in which a variety of prepared screens or rubber plates would be used, one screen (or rubber plate) would correspond to each color to be provided in the palette. For example, a screen would be provided which would cover all of the substrate except that area where the color red was to be deposited. Then a second screen, which covered the first (red) color deposited, would be used to print a different color on a different portion of the substrate. This procedure would be repeated until all of the desired colors were provided on the substrate to provide the final palette.

In the preferred embodiment, the preferred binder is cold water soluble. Examples of such preferred binders are gum arabic, methyl cellulose and others having similar properties and known in the art. Such binders allow the palette to be re-wetted and transferred.

In a further embodiment, an adhesive is provided around the perimeter of the printed palette and a layer of acetate is overlaid over the palette and contacts the adhesive. This provides for a protective coating over the palette to prevent the loss of paint during packaging, shipping and non-use. Alternatively, the adhesive may be applied to only one edge of the perimeter and the acetate layer provided to contact the adhesive. In this manner, the acetate protective layer may be lifted and folded away from the palette during its use while remaining attached. After the palette is used, the acetate layer may be replaced over the palette for further protection.

The preferred embodiment of the present invention provides a method for preparing a color palette consisting of printable water color paints containing microencapsulated chemicals which provide fragrance effects. In the preferred embodiment, a printable water color paint which contains water and water-soluble pigment and binders is mixed with a quantity of microcapsules containing a desired fragrance. The microcapsules are of a type which are pliable when contained in a liquid solution such that the microcapsules may be deformed without causing a rupture of the capsule and release of the chemical contents. In this embodiment, the liquid mixture of microcapsules and water color paint are printed on a substrate, such as paper, to form layers of water color paint containing microcapsules on the substrate. These layers of water color paint and microcapsules are then allowed to dry to form dry cakes or films of the water color paint and microcapsule mixture.

In a preferred embodiment the dried layer of water color paint and microcapsules on the substrate is of an appropriate thickness and configuration so that a brush containing an appropriate solvent, i.e., water, may be contacted with the dried layer. Upon contact with the layer, pigment is redissolved in the solvent and the binders are broken down so that water color paint and microcapsules are redispersed in the solvent and picked up by the brush. The loaded brush may then be used to transfer color and microcapsules to a desired surface or object. After the transferred water color paint and microcapsule mixture has been allowed to dry, a viewer of the artwork may rupture the microcapsules, as by scratching the painted surface, to release the chemical to produce the desired effect. In a preferred embodiment the percentage of water color paint is between about 50% to 70% and the percentage of microcapsules is between about 30% and 50%. In another preferred embodiment the percentage of water color paint is about 60% and the percentage of microcapsules is about 40%.

BRIEF DESCRIPTION OF THE DRAWINGS

The above and further features of the present invention may be best understood with reference to the following Detailed Description and FIGURES in which.

DETAILED DESCRIPTION OF A PREFERRED EMBODIMENT

Figure 1:
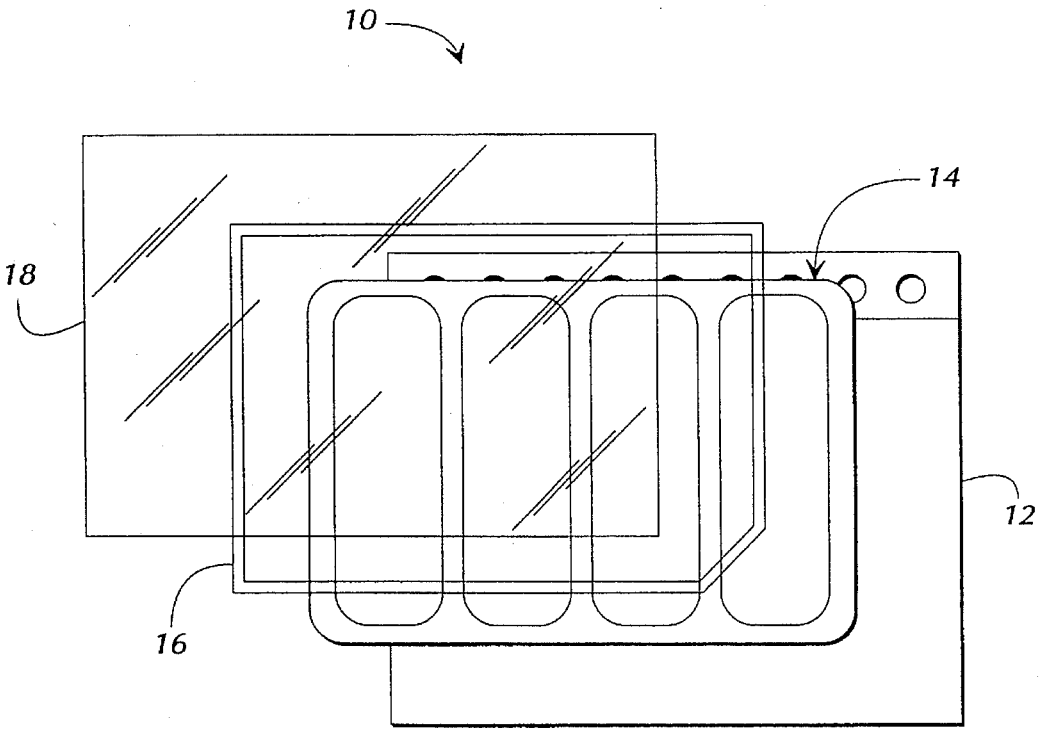
FIG. 1 is an exploded view of a palette prepared according to the method of the invention.

Referring now to the drawings in which like reference numerals refer to like or corresponding features, there is shown in FIG. 1 a generalized view of a color palette 10 in exploded view consisting of a substrate 12 upon which is printed a layer 14 of the desired palette material. In the preferred embodiment, the printed layer 14 is a water color paint containing microencapsulated fragrances. In a further preferred embodiment, a layer of adhesive 16 is applied to the perimeter of the color palette 10. Adhered to the adhesive layer 16, is an acetate layer 18 which covers the palette 10 and protects the cake from loss during packaging, shipping or periods of non-use. The printed palette is preferably formed using either the silk screen or flexographic printing processes. For example, the desired ink, which would consist of pigments, microcapsules, solvents and cold water soluble binders, would be printed through a mesh screen in ways known in the art. In a preferred embodiment, a variety of screens would be used for different colors each allowing for placement of a different color/scent combination on substrate 12 in different areas of the substrate 12 to provide multiple color areas on a single palette. The preferred screen is a 200 mesh screen with an opening size of approximately 125 microns, which allows sufficient ink to be printed during the process to achieve a cake thickness between approximately 1 and 2 mils. A thickness of less than about 1 mil provides insufficient color in the cake 10 for effective color transfer in painting a subsequent design. In the preferred embodiment, the binder, which performs the function of holding the ink/microcapsule mixture together once it has dried, is selected to be a cold water soluble binder. In typical printing applications, the binder, even when water soluble, is selected from the group of binders which are not resoluble once printed and dried. Such traditional binders are binders such as hot water soluble polyvinyl alcohol, starches and polymer emulsions. These binder systems have traditionally been used in the printing art to provide for durable printed matter even when a water soluble binder is preferred; these are the types of binders contemplated in the Whitaker patent.

Figure 2:
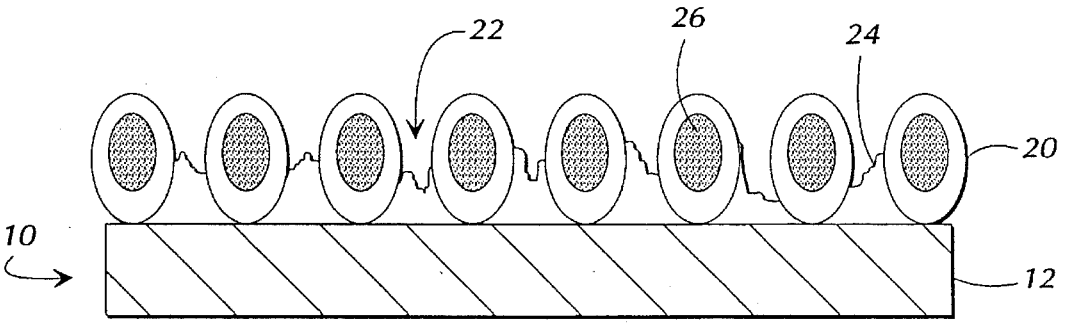
FIG. 2 is a cross-section view of the position of a color palette.

There is shown in FIG. 2, a cross-section of a portion of a color palette prepared using the process of the invention. A dried layer of paint and microcapsules 22 is made in accordance with the present invention. Layer 22 consists of a substrate 12 onto which has been printed a paint mixture layer 20 containing water soluble pigments and binders 24 and microencapsulated fragrances 26. The layer 22 begins as a liquid mixture of water soluble pigments and binders to which has been added microcapsules containing a desired fragrance. The microcapsules 26 are designed so that they are deformable and not easily ruptured when contained in a liquid medium so that they may be printed without rupturing. The paint/microcapsule mixture may then be printed onto a substrate 12 by a variety of printing means to form the layer 22 containing pigment and binders 24 and microcapsules 26; preferably the layer is between about 0.001" and 0.002" thick. After the layer 22 has dried, the pallette 10 is ready for sale and use by a consumer.

Figure 3:
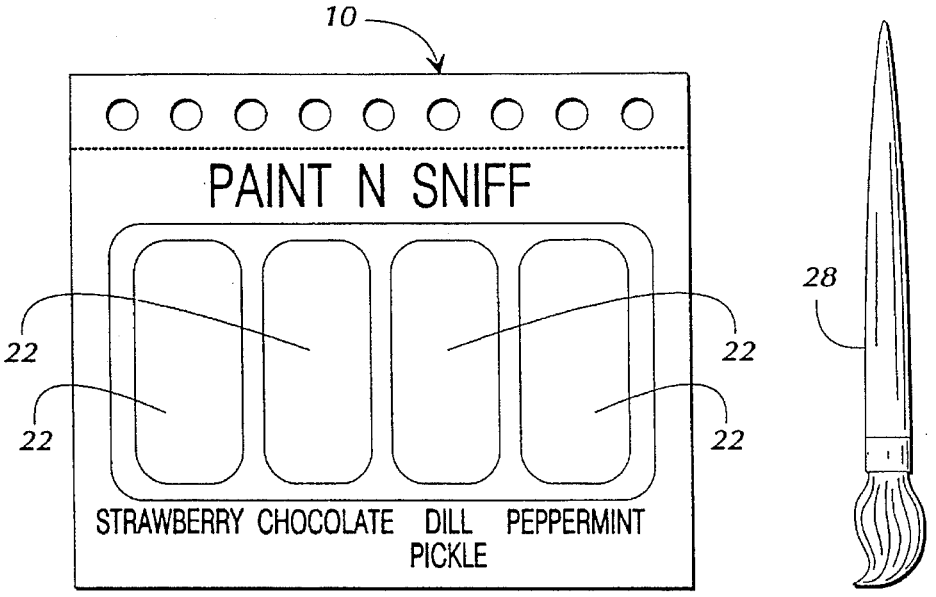
FIG. 3 is a view of a painting kit.
Figure 3:
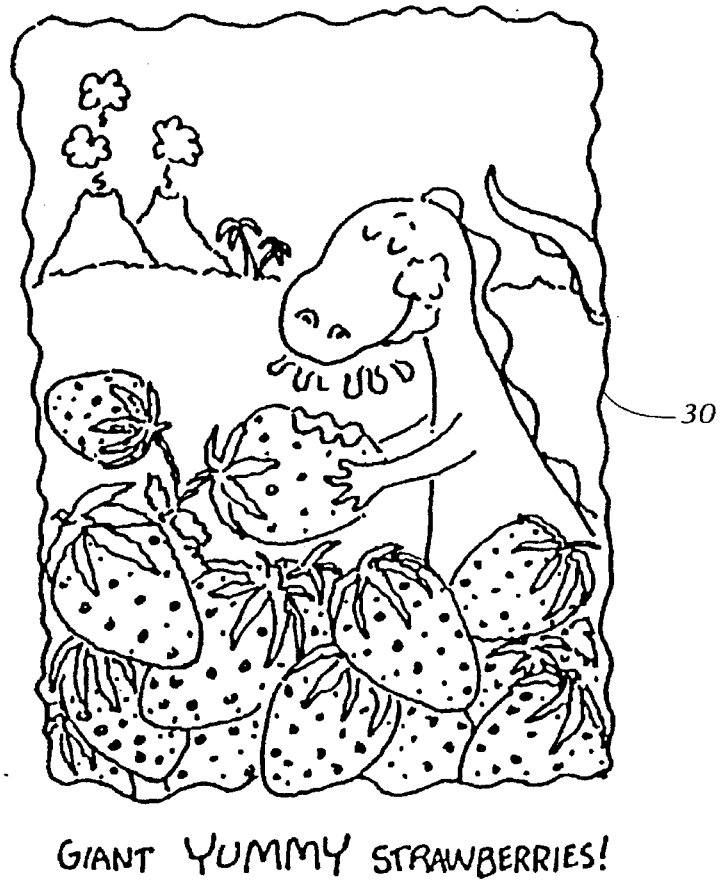

Referring now to FIG. 3, in use, a user would dip a brush 28 such as a common artist's paint brush, in appropriate solvent such as water. As shown in FIG. 3, each of the layers 22 would consist of a different color/fragrance combination. The brush 28 would then contain solvent within the fibers and would then be contacted with the dried paint/microcapsule layer 22. Solvent from the brush would redissolve the pigment and binders 24 and redisperse the microcapsules 26. The contact of the brush with the layer 22 would also serve to load the brush with dissolved pigment and binder 24 and dispersed microcapsules 26 so that they could be transferred. The brush would then be contacted with something the user desired to paint (such as a pre-printed scene 30) and the dissolved pigment and binder 24 and dispersed microcapsules 26 would be transferred to that object by contact to the brush with that object.

Subsequently, the paint/microcapsule mixture on the desired scene would dry such that the pigment and microcapsules would form a dry film of pigment, binders and hardened microcapsules on the object painted. After the mixture had dried on the object, a person desiring to release the fragrance from the microcapsules could rupture the microcapsules, as by scratching with their fingernail, and the chemicals would be released so that the fragrance contained in the microcapsule could be detected by the person rupturing the microcapsules.

In a preferred embodiment, the preferred paint would be a water color paint such as that made by Colorcon, Inc.; this paint is available in four basic colors, red, yellow, blue and black, with these four colors being combinable to form almost any other desired color. To the liquid paint, a water soluble binder, preferably carboxy methyl cellulose, gum arabic or equivalent cold water soluble binders, would be added in sufficient quantity, preferably between about 1.0% and 2.0%, to allow the paint to be printed in layers of desired thickness and to bind microcapsules within the layer. To the paint solution containing water soluble pigment and binders, microencapsulated chemicals such as those made by MICRO-SCENT, Inc., would be added to provide a liquid dispersion containing dissolved pigment and binders and dispersed microcapsules. The pigment and microencapsulated chemical would be selected so that the combination would provide for a desired visual and scent effect.

For example, a bright red pigment could be combined with a microencapsulated chemical which approximates the scent of strawberries to provide a strawberry-red paint/microcapsule mixture. The strawberry-red mixture could be used to paint a picture of a strawberry or any other object which the person would desire to have the strawberry-red color/fragrance combination. After the picture has been painted and the paint/microcapsule film has been allowed to dry, a viewer desiring to release the microencapsulated fragrance could then scratch the painted surface with their fingernail and release the microencapsulated fragrance so that the picture smelled of strawberries.

A wide variety of color and fragrance or color and flavor combinations can be created to produce a wide variety of effects. For example, MICRO-SCENT, Inc., manufactures over one hundred different microencapsulated fragrances and a large variety of different colored water color paints can be produced in ways well-known in the art.

In a preferred embodiment, the paint/microcapsule mixture is comprised of between about 50% to 70% liquid paint containing dissolved pigment and binders and between about 30% to 50% microencapsulated chemicals. This mixture is mixed by a low shear mixing method to prevent the rupture of microcapsules. Upon completion of the mixing so that the microcapsules are uniformly dispersed in the liquid, the paint/microcapsule mixture is provided as the ink in a printing procedure or may be injected or poured into prefabricated containers and allowed to dry to form cakes.

The preferred printing method is silk screen printing although it is anticipated that the flexographic process will be more economical and become the preferred method of printing. In this procedure, the substrate 12 onto which a layer of paint and microcapsules 14 is to be printed is provided beneath a silk screen in a silk screen press; the preferred substrate is uncoated paper so that the layer will adhere to the paper fibers. The silk screen has been prepared in ways well-known in the art so that the liquid print/microcapsule dispersion will be printed onto the desired areas of the substrate. The paint/microcapsule mixture is provided on the surface of the silk screen or rubber plate opposite the substrate and a squeegee is passed over the top surface of the screen or rubber plate in order to force the paint/microcapsule mixture through the open portions of the screen or rubber plate and onto the substrate to form the layer 14. As was previously described, the microcapsules are of a composition so as to be deformable while in a liquid dispersion so that the shear forces incurred during the printing process will not rupture the microcapsules.

Subsequent to the printing, the layer 14 adheres to the substrate 12 by action of the binders and the printed substrate sheet is allowed to dry either by unassisted air drying or assisted heat drying. Upon drying, the layer 14 consists of a dried mixture of pigment and binder 24 and microcapsules 26.

It should be noted that a substrate 12 could be printed several times using different screen and paint/microcapsule combinations to provide separate areas of paint/microcapsule layers having various color and scent combinations on a single sheet. In an alternate embodiment, the water soluble binder used could be polyvinyl alcohol or any other of a variety of water soluble binders. Additionally, in an alternate embodiment, the substrate could be a coated paper product or, in fact, could be any of a variety of appropriate substrates such as cardboard, wood or plastic. Finally, a variety of printing processes may be used to place the layer 14 on the substrate 12 such as flexographic, offset or gravure. It should also be noted that the liquid paint/microcapsule dispersion could be poured or injected into preformed trays and allowed to dry to form cakes.

The following example describes in detail the process for preparing a palette as described above.

EXAMPLE I

A mixture of water color ink, such as that manufactured by Colorcon, Inc., a microencapsulated fragrance, such as that produced by MICRO-SCENT, Inc., was produced using 50% ink and 50% microcapsules dispersed in a cold water soluble binder such as gum arabic or methyl cellulose. The mixture was printed using the silk screen process using a 200 mesh screen, configured as known in the art to apply the desired color to a selected portion of a substrate. The printed product was allowed to dry completely. The resulting printed product had a thickness of approximately 1–2 mils, which is sufficiently thick to allow for subsequent re-wetting of the printed product and transfer of the mixture in sufficient quantity to a desired design utilizing a standard artists brush wetted with water. Thicknesses less than about 1 mil have been printed and do not allow sufficient paint to be picked up upon re-wetting to be effectively transferred.

For protection during packaging, shipping and non-use, a layer of adhesive was placed on the substrate around the perimeter of the palette and a layer of acetate was placed over the printed product and adhered to the adhesive layer. Alternatively, a layer of adhesive may be placed on one edge of the perimeter of the palette or printed product and the acetate may be adhered to that one edge only which allows the acetate to be folded out of the way during use of the palette and folded back into place when the palette is not being used.

While a preferred embodiment of the present invention has been described herein, the present invention is capable of numerous alternate embodiments or changes, modifications or deletions without departing from the scope of the invention as defined by the claims; therefore, the foregoing detailed description of a preferred embodiment was by way of illustration and not limitation.

What I claim is:

1. A method for transferring one or more colored microencapsulated fragrances from a pallet comprising:

providing a substrate for colored microencapsulated fragrances;

depositing about 1 mil to about 2 mils in thickness of one or more transferable layers on said substrate, each said transferable layer comprising pigment, a microencapsulated fragrance and water soluble binders for the pigment and microencapsulated fragrances and each of said layers being deposited in a spatially separate location on said substrate;

drying said one or more of deposited layers;

redissolving at least a portion of said dried layer by contacting said dried layer with water and a brush so as to load said brush with redissolved colored microencapsulated fragrances; and contacting said brush containing redissolved colored microencapsulated fragrances with an object to be colored.

2. The method of claim 1 wherein the binders are selected from the group consisting of gum arabic and methyl cellulose.

3. The method of claim 2 further comprising the steps of:

providing an adhesive layer around a perimeter of said dried layers on said substrate; and providing an acetate layer having edges over said dried layers such that the edges of said acetate layer contact said adhesive layer to hold said acetate layer in place.

4. The method of claim 3 wherein said transferable layer contains between about 50%–70% liquid paint comprising dissolved pigments and binder and between about 30%–50% microencapsulated fragrances.

5. The method of claim 2 wherein said transferable layer contains between about 50%–70% liquid paint comprising dissolved pigments and binder and between about 30%–50% microencapsulated fragrances.

6. The method of claim 1 further comprising the steps of:

providing an adhesive layer around a perimeter of said transferable colored layers on said substrate; and providing an acetate layer having edges over said transferable colored layers such that the edges of said acetate layer contact said adhesive layer to hold said acetate layer in place.

7. The method of claim 1 wherein said transferable layer contains between about 50%–70% liquid paint comprising dissolved pigments and binder and between about 30%–50% microencapsulated fragrances.

* * * * *